United States Patent [19]

Palau

[11] 4,187,886

[45] Feb. 12, 1980

[54] DOBBY FOR THE FORMATION OF THE SHED ON LOOMS

[75] Inventor: Joseph Palau, Duingt, France

[73] Assignee: S.A. des Etablissements Staubli, Faverges, France

[21] Appl. No.: 929,140

[22] Filed: Jul. 28, 1978

[30] Foreign Application Priority Data

Oct. 14, 1977 [FR] France ..... 77 31678

[51] Int. Cl.[2] ..... D03C 1/26

[52] U.S. Cl. ..... 139/68; 139/71; 139/74

[58] Field of Search ..... 139/66 R, 68, 69, 71, 139/72

[56] References Cited

U.S. PATENT DOCUMENTS

| | | | |
|---|---|---|---|
| 3,665,973 | 5/1972 | Reisdorf | 139/71 |
| 3,851,675 | 12/1974 | Schwarz | 139/71 |

FOREIGN PATENT DOCUMENTS

| | | | |
|---|---|---|---|
| 1535240 | 2/1971 | Fed. Rep. of Germany | 139/71 |
| 1760849 | 1/1972 | Fed. Rep. of Germany | 139/71 |

*Primary Examiner*—Henry Jaudon

*Attorney, Agent, or Firm*—Dowell & Dowell

[57] ABSTRACT

A dobby for the formation of the shed on weaving looms, of the type in which each of the double swinging levers coupled to the heddle frames of the loom is displaced alternately by two pivoted pulling hooks which are controlled on the one hand downwardly by transverse lowering knives adapted to bring them in contact with pulling knives, on the other hand upwardly by stirrups under the control of the pattern mechanism and associated with lifting means which enable said hooks to displace the said pulling knives, wherein the lifting means are constituted by crosspieces directly fixed to the transverse lowering knives while the stirrups are shaped to cooperate with the said crosspieces when they receive the action of rocking levers placed under the control of the pattern mechanism.

4 Claims, 4 Drawing Figures

DOBBY FOR THE FORMATION OF THE SHED ON LOOMS

The present invention relates to devices known under the name of "dobbies" and intended to be associated with weaving looms with a view to forming the shed, and it concerns more particularly the mechanisms in which the double swinging levers are actuated, not directly by crosspieces having a reciprocating movement, but by pulling hooks.

As shown schematically in FIG. 1 of the accompanying drawings, such a dobby generally comprises a pattern mechanism 1 of the punched card and needle type, each group of four needles ensuring the control of two push rods 2 (one push rod for forward operation, another for reverse motion or "unweaving") which, according to whether or not they are selected by the design, i.e. according to whether or not the corresponding part of this design presents perforations, move axially against return springs or, on the contrary, return to rest position.

Each push rod 2 is coupled to a vertical rod 3 whose lower end carries a stirrup member 4 provided with an eye through which a pulling hook 5 freely passes. The two hooks 5 are pivoted on the opposite ends of a double swinging lever 6 mounted on a pivot 7 itself carried by an actuating lever 8. This latter is supported by a fixed shaft 9 and is coupled by a connecting rod 10 to the lever or pulling cable associated with one of the heddle frames of the loom. Two fixed transverse stops 11 are provided at one of the ends of the reciprocating pivoting stroke of the double swinging lever 6, this pivoting movement achieving the to and fro actuation of the rod 10 and the corresponding frame.

The pulling hooks 5 present at their free end a downwardly facing nose so as to cooperate with an edge made on one or the other of two knives 12, performing a reciprocating movement along an arcuate path. It will be noted that to each of these knives 12 there is coupled, by a system of connecting rods, a transverse stop 13 which therefore moves in reciprocating manner at the same time as the corresponding knife. The lowering of the hooks 5 with a view to their being seized by the knives 12 is effected by two knives 14 carried by sleeves 15 clamped on two transverse shafts 16 performing an oscillating movement. During the return of the knives 12 in the direction of seizing position, two solutions may occur:

either the hook 5 envisaged has been selected by the pattern mechanism, in which case the corresponding stirrup 4 is maintained in low position and the hook 5 will be taken by the knife 12 which is associated therewith; or the hook 5 in question has not been selected, because the push rod 2, not controlled by the mechanism 1, returns to its left position under the effect of its return spring 17, each stirrup 4 having a certain angular clearance on the lower toothed member 18 which ensures its vertical guiding.

In this latter case, the hook 5 which has not been selected must of course be raised in order to allow it to escape the action of the corresponding knife 12. To this end, there are provided in the conventional dobbies two upper knives 19 to which a cam mechanism 20 imparts a reciprocating vertical displacement associated with that of the lowering knives 14; these knives 19 are intended to cooperate with grippers 21 fixed to the top of the rods 3 and they are disposed so as to seize the gripper 21 of the stirrups whose push rod 2 has returned into rear position.

It will be readily appreciated that the functioning of such a dobby involves an exact setting of the knives 12, 14 and 19, so that the least error in the initial adjustment or the least untimely misadjustment during functioning not only provokes stoppage of the loom, but also risks seriously damaging the dobby.

The improvements forming the subject matter of the present invention envisage remedying this drawback, whilst simplifying the construction of the dobby.

In accordance with the invention, the non-selected hooks are raised with the aid of crosspieces fixed on the members or sleeves which support the oscillating lowering knives, these crosspieces and the stirrup members being shaped so that the slight angular displacement of said stirrup members, under the effect of the pattern mechanism, enables said stirrups to escape the action of said cross pieces.

The invention will be more readily understood on reading the following description with reference to the accompanying drawings, in which:

FIG. 1 schematically illustrates the prior art arrangement of a conventional dobby, as discussed hereinabove.

Figure 1:
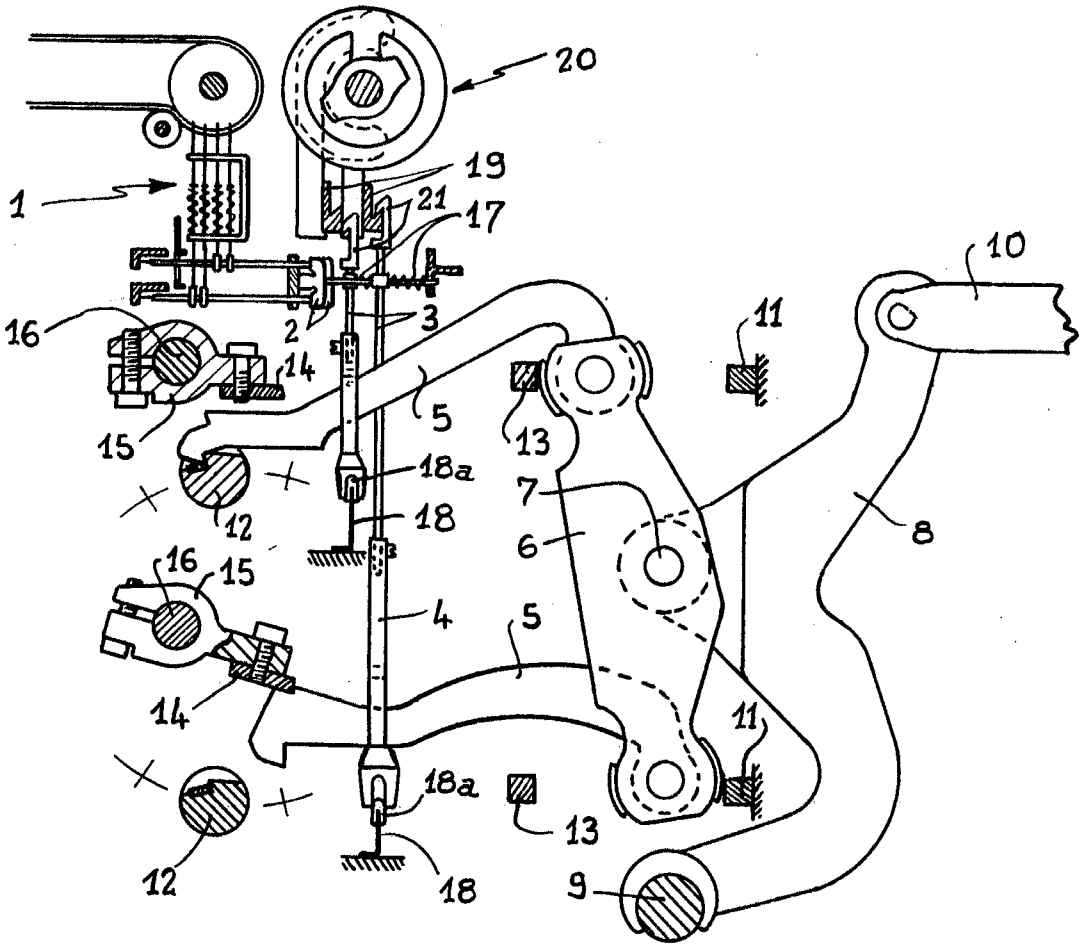
Fig. 1 PRIOR ART
Figure 2:
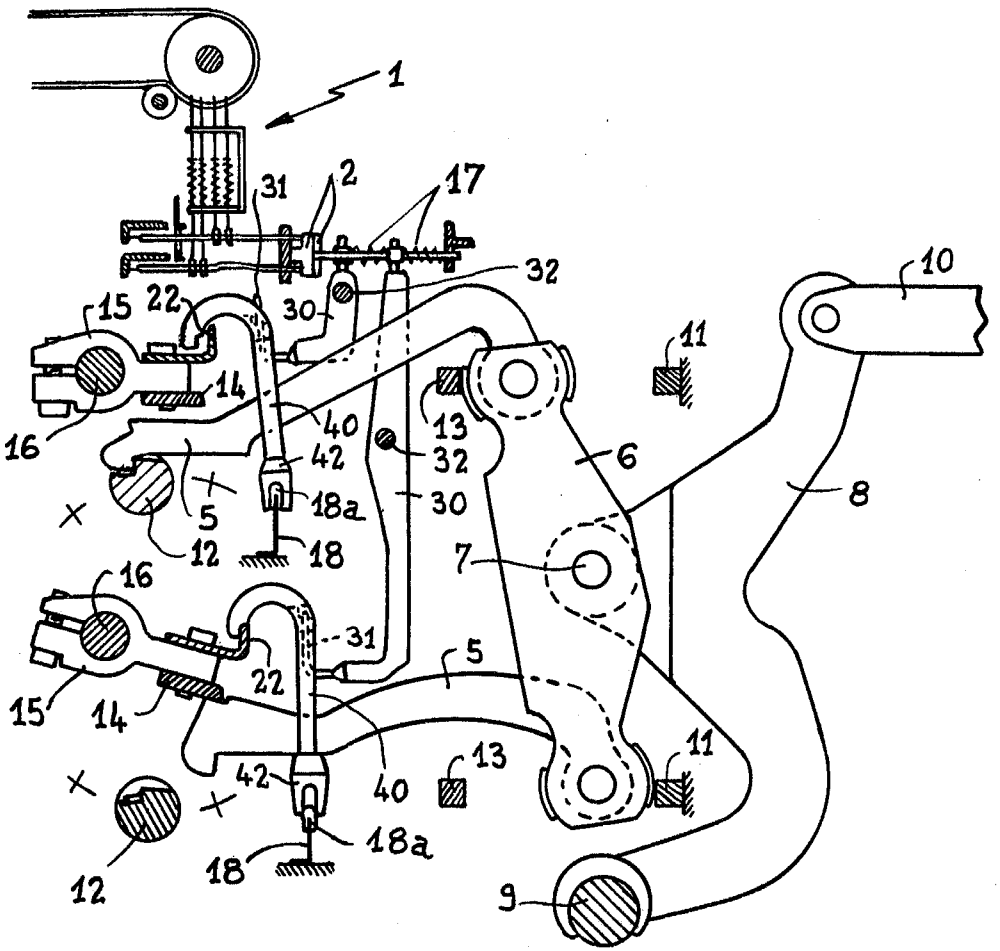
FIG. 2 shows, in a similar view, the general arrangement of a dobby according to the invention.

In the dobby shown in FIG. 2 there is included a pattern mechanism 1, two push rods 2 for each heddle frame, two hooks 5 associated with an assembly 6–7–8–9–10, two oscillating knives 14 and two reciprocating pulling knives 12 coupled to two mobile stops 13, all these elements being identical to those of FIG. 1. On the contrary, each stirrup member, here referenced 40, presents a side section substantially in the form of a crook, whilst each of the suspension rods 3 of FIG. 1 is replaced by a rocking lever 30.

Figures 3, 4:
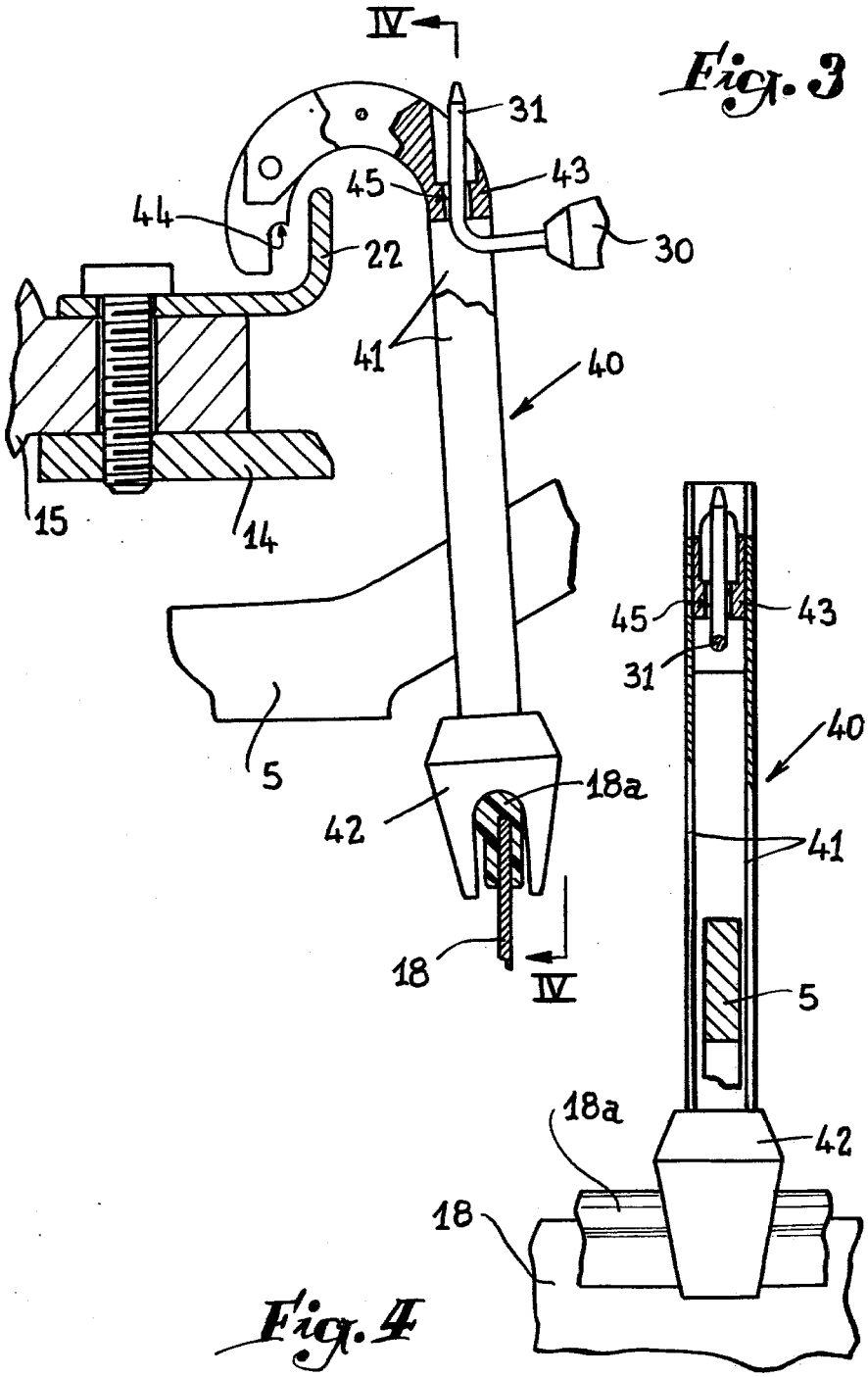
FIG. 3 is a vertical section, on a larger scale, of one of the stirrup members of the dobby according to FIG. 2.
FIG. 4 is a section along IV—IV of FIG. 3.

As illustrated in FIGS. 3 and 4, each stirrup member 40 is advantageously constituted by two side members 41 maintained in spaced apart relationship by the interposition on the one hand of a lower end piece 42 cut out from an opening adapted to overlap the conventional fitting 18*a* of the corresponding toothed member 18, on the other hand by a head 43 of semi-circular section. The end of this head 43 which passes beyond the side members 41 is shaped so as to present a nose 44, whilst, opposite, said head is pierced with a vertical hole 45 inside which is engaged, with clearance, the upwardly bent end of a rod 31 added at the end of the corresponding rocking lever 30. It will be noted that said lever pivots at 32 (FIG. 2) on the fixed frame of the dobby and that the spring 17, engaged on the axial extension of the corresponding push rod 2 between a fixed piece and the point of coupling of the rocking lever in question on the said extension, permanently tends to make this rocking lever tip and thus to bring the stirrup 40 to such a position that the nose 44 abuts against the upper free edge of a crosspiece 22 added to the sleeves 15 of each of the two knives 14, each of said crosspieces 22 thus being animated by the same oscillating movement as the said knives.

The functioning of the dobby according to FIG. 2 is substantially identical to that set forth with reference to FIG. 1, in that the lowering of the hooks 5 is effected with the aid of the two knives 14 which oblige the nose of said hooks to come into engagement with the pulling knives 12, this having for its effect to control the actuating levers 8 of the dobby alternately.

When the pattern mechanism 1 ensures the axial displacement of the push rods 2 to the right, the rocking levers 30 corresponding to the hooks 5 thus selected tip about their pivot 32 and push the stirrups 40 which are associated therewith, so that the nose 44 thereof is offset leftwardly with respect to the edge of the crosspiece 22 (this is the case for the stirrup 40 of the hook 5 which is located in the upper part of FIG. 2 and which has been shown in detail in FIG. 3); the oscillation of this crosspiece 22 has no action on the stirrup 40 in question, so that said latter remains in low position and the corresponding hook 5 is again drawn to the left by the knife 12.

On the contrary, when there is no selection, i.e. when the needles of the mechanism 1 do not drop into the perforations of the card or design, the push rods 2 envisaged remain to the left under the effect of their spring 17, without actuating the rocking levers 30. The stirrups 40 consequently remains to the right and its nose 44 is consequently disposed on the oscillating path of the edge of the crosspiece 22 (case of the lower stirrup 40 in FIG. 2). The stirrup 40 has therefore risen, ensuring the rise of the pulling hook 5 which passes through the stirrup and which consequently escapes the oscillating knife 12.

Finally, the invention makes it possible to do without the cam mechanism 20 of the conventional art, this substantially simplifying the construction of the dobby and reducing the cost thereof. Moreover, and in particular, the lowering of the pulling hooks and their rise in the case of non-selection are effected by the same assembly 15–16, this considerably limiting the risks of misadjustment.

What is claimed is:

1. In a loom dobby having a frame supporting multiple double swinging levers each coupled to a heddle frame, each lever being displaceable by two pulling hooks pivotally connected thereto, the dobby having pulling knives operative to displace the pulling hooks when the latter engage the pulling knives, the dobby having lowering knives operative when contacting the hooks to move them into engagement with the pulling knives, and the dobby having a pattern mechanism, improved means for raising the pulling hooks out of engagement with the pulling knives under the control of the pattern mechanism, comprising:

a crosspiece coupled with each lowering knife and moving through a path therewith;

a stirrup associated with each pulling hook and having a first portion located to engage the pulling hook and having a second portion located adjacent to a crosspiece;

a rocking lever associated with and coupled to each stirrup and carried by the frame, each rocking lever being coupled with the pattern mechanism and selectively actuated thereby to move the second portion of the stirrup selectively out of the path of the crosspiece or into the path of the crosspiece whereby to raise the stirrup and move the associated pulling hook away from the engagement with the pulling knife.

2. The improved dobby as claimed in claim 1, wherein said crosspieces and said lowering knives are respectively fixed to a common supporting member for unitary movement therewith.

3. The improved dobby as claimed in claim 1, wherein said second portion of each stirrup is formed to provide a nose which is moved selectively into the path to engage the corresponding crosspiece or out of the path thereof.

4. The improved dobby as claimed in claim 3, wherein said pattern mechanism has push rods and each rocking lever has one end actuated by a push rod and another end hooked upwardly and engaged in an opening in the corresponding stirrup.

* * * * *